US011229988B2

(12) United States Patent
Mader

(10) Patent No.: US 11,229,988 B2
(45) Date of Patent: Jan. 25, 2022

(54) KNIFE SHARPENING DEVICE

(71) Applicant: ZWILLING J.A. HENCKELS AG, Solingen (DE)

(72) Inventor: Sebastian Mader, Hilden (DE)

(73) Assignee: ZWILLING J.A. HENCKELS AG, Solingen (DE)

( * ) Notice: Subject to any disclaimer, the term of this patent is extended or adjusted under 35 U.S.C. 154(b) by 0 days.

(21) Appl. No.: 16/954,224

(22) PCT Filed: Nov. 26, 2018

(86) PCT No.: PCT/EP2018/000535
§ 371 (c)(1),
(2) Date: Jun. 16, 2020

(87) PCT Pub. No.: WO2019/120600
PCT Pub. Date: Jun. 27, 2019

(65) Prior Publication Data

US 2020/0306934 A1 Oct. 1, 2020

(30) Foreign Application Priority Data

Dec. 18, 2017 (DE) ..... 10 2017 011 680.6

(51) Int. Cl.
*B24D 15/08* (2006.01)

(52) U.S. Cl.
CPC ..... *B24D 15/081* (2013.01)

(58) Field of Classification Search
CPC .... B24B 3/36; B24B 3/52; B24B 3/54; B24D 15/06; B24D 15/063; B24D 15/081; B24D 15/085
USPC ..... 451/321
See application file for complete search history.

(56) References Cited

U.S. PATENT DOCUMENTS 1,909,743 A 5/1933 Blankner
2,124,646 A 7/1938 Barsch
2,249,218 A * 7/1941 Meade ..... B24D 15/081 451/486

(Continued)

FOREIGN PATENT DOCUMENTS

CN 1367065 A 9/2002
CN 2882904 Y 3/2007

(Continued)

*Primary Examiner* — Orlando E Aviles
*Assistant Examiner* — Jacob Adam Montgomery
(74) *Attorney, Agent, or Firm* — Norman B. Thot

(57) ABSTRACT

A device for sharpening a knife. The device includes an enclosure, first and second grinding strips, first and second grinding strip holders, and first, second, third and fourth pendulum rods. Each of the first and second grinding strip holders have a lower section. The first grinding strip holder holds the first grinding strip and the second grinding strip holder holds the second grinding strip. The first and second grinding strip holders are movably arranged next to each another in the enclosure so that the first and second grinding strips intersect to form a movable sharpening slot having a V-shape. The first and second pendulum rods are hinged to the first grinding strip holder at the lower section via a lower joint. The third and forth pendulum rods are hinged to the second grinding strip holder at the lower section via a lower joint.

15 Claims, 5 Drawing Sheets

(56) References Cited

U.S. PATENT DOCUMENTS

| | | | | |
|---|---|---|---|---|
| 6,726,551 | B2 * | 4/2004 | Friel, Sr. ..... | B24D 15/08 30/298.4 |
| 2002/0094768 | A1 | 7/2002 | Friel | |
| 2005/0217433 | A1 | 10/2005 | Pretorius | |
| 2018/0178352 | A1 | 6/2018 | Eklund | |

FOREIGN PATENT DOCUMENTS

| | | | | | |
|---|---|---|---|---|---|
| CN | 203818000 | U | | 9/2014 | |
| CN | 204736111 | U | | 11/2015 | |
| CN | 204748370 | U | | 11/2015 | |
| DE | 200 07 691 | U1 | | 8/2000 | |
| DE | 102 97 613 | T5 | | 1/2005 | |
| EP | 1 223 006 | A2 | | 7/2002 | |
| GB | 474100 | A | * | 10/1937 | ..... B24D 15/082 |
| GB | 474100 | A | | 10/1937 | |
| SE | 1350999 | A1 | | 3/2015 | |
| WO | WO 03/055646 | A1 | | 7/2003 | |
| WO | WO 2016/186567 | A1 | | 11/2016 | |

* cited by examiner

KNIFE SHARPENING DEVICE

CROSS REFERENCE TO PRIOR APPLICATIONS

This application is a U.S. National Phase application under 35 U.S.C. § 371 of International Application No. PCT/EP2018/000535, filed on Nov. 26, 2018 and which claims benefit to German Patent Application No. 10 2017 011 680.6, filed on Dec. 18, 2017. The International Application was published in German on Jun. 27, 2019 as WO 2019/120600 A1 under PCT Article 21(2).

FIELD

The present invention relates to a device for sharpening knives, the device having two grinding strip holders each holding one grinding strip, wherein the grinding strip holders are movably arranged next to each other in an enclosure so that the two intersecting grinding strips form a movable V-shaped sharpening slot.

BACKGROUND

Such a knife sharpener is described in U.S. Pat. No. 1,909,743. With this sharpener, which is an elaborately large construction, the two grinding blocks are attached to joints so that when the knife is pulled through, the grinding blocks tilt and the sharpening angle changes, thus resulting in different wedge angles at the blade.

SUMMARY

An aspect of the present invention is to improve a blade sharpening device of the type mentioned above so that optimum sharpening results can be achieved with a small and simple construction.

In an embodiment, the present invention provides a device for sharpening a knife. The device includes an enclosure, a first grinding strip, a second grinding strip, a first grinding strip holder, a second grinding strip holder, a first pendulum rod, a second pendulum rod, a third pendulum rod, and a fourth pendulum rod. Each of the first grinding strip holder and second grinding strip holder comprise a lower section. The first grinding strip holder is configured to hold the first grinding strip and the second grinding strip holder is configured to hold the second grinding strip. The first grinding strip holder and the second grinding strip holder are movably arranged next to each another in the enclosure so that the first grinding strip and the second grinding strip intersect to form a movable sharpening slot having a V-shape. The first pendulum rod and the second pendulum rod are hinged to the first grinding strip holder at the lower section via a lower joint. The third pendulum rod and the fourth pendulum rod are hinged to the second grinding strip holder at the lower section via a lower joint.

BRIEF DESCRIPTION OF THE DRAWINGS

The present invention is described in greater detail below on the basis of embodiments and of the drawings in which.

DETAILED DESCRIPTION

Figure 1:
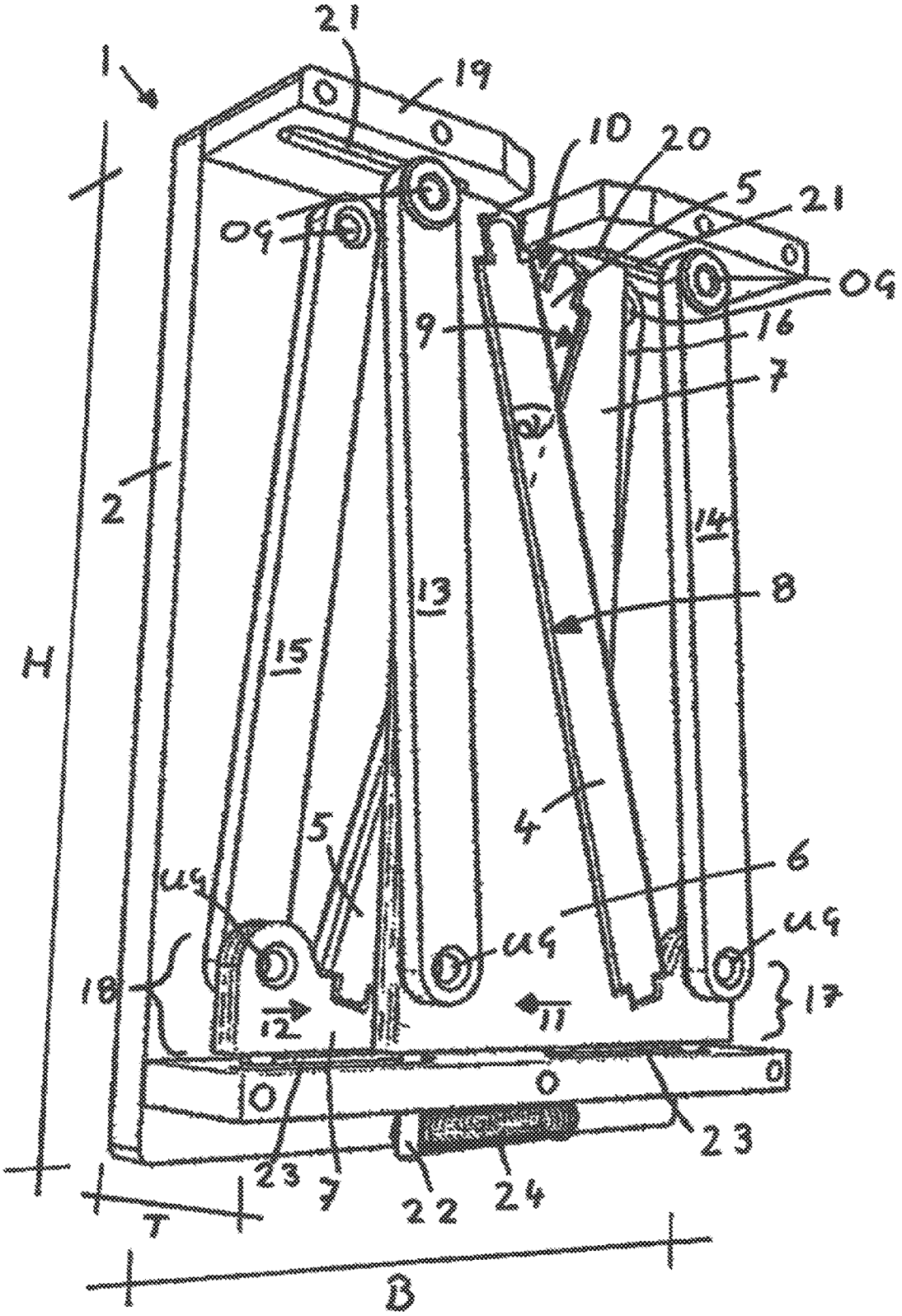
FIG. 1 shows a first embodiment of the present invention with a removed front wall and without side walls.

The present invention provides that the grinding strip holders are each hinged with their lower section on two pendulum rods via lower joints.

When the knife's blade is pulled top down through the sharpening slot, this pendulum suspension and thus parallel guidance of both grinding strip holders results in a uniform lateral movement of the grinding strip holders without tilting. The sharpening angle of the two grinding strip holders rather always remains the same so that an unchanged wedge angle is achieved over the entire length of the blade. A sufficiently long sharpening path is thereby provided. This pendulum suspension is of a simple construction, has a high functional reliability, and a long life. It also results in a particularly smooth functioning of the knife sharpening device.

A simple and safe construction is achieved when the pendulum rods are hinged in the upper section of the enclosure.

In an embodiment of the present invention, each grinding strip holder can, for example, be formed by a plate-like member and the two plate-like members can, for example, be arranged parallel next to one another and in particular vertically. This plate configuration not only results in a simple and stable construction, but also in an especially compact design with small external dimensions.

Non-jamming movements are achieved when the upper section of each grinding strip holder is guided in the enclosure. Each grinding strip holder can, for example, have at least one projection that is inserted in a longitudinal slot in the enclosure top therefor.

The guidance of the grinding strip holders is further improved in that the lower section of each grinding strip holder is guided in the enclosure. Each grinding strip holder can, for example, have at least one projection at its bottom side therefor, which projection is inserted in a longitudinal slot in the enclosure bottom.

The two grinding strip holders are each influenced by a spring element, wherein the spring element can, for example, be a tension spring between bottom projections of the grinding strip holders and be attached thereto. It is alternatively proposed that the spring element be attached between the projection of a grinding strip holder and the enclosure.

Each grinding strip holder has an end face to which the grinding strip is attached. In this respect, it is advantageous:

- when the grinding strips can be adjusted by rotation about their longitudinal axis;
- when each grinding strip has at least two longitudinally arranged sections of different roughness, for example, a honing section and a grinding section;
- when the two grinding strips are each held in a longitudinal groove in the end face of the grinding strip holder, in particular held so that they can be adjusted by rotation;
- when the longitudinal groove partly engages the grinding strip at least in a bottom section;

when the grinding strips can be pulled out to the top from the fastening of the grinding strip holder and can thus be replaced.

To allow a particularly easy actuation of the grinding strips, it is proposed that at the upper end of each grinding strip a handle be attached which projects from the top of the enclosure. The grinding strip holder may form snap positions for the handle.

It is especially advantageous when for both grinding strip holders, the position of one of the upper hinges can each be vertically adjusted, in particular by a rotary slide, in order to adjust different sharpening slot angles.

In an embodiment of the present invention, it is proposed that the pendulum rods of each grinding strip holder can, for example, be arranged parallel to one another.

In an embodiment of the present invention, an adapter strip holding the grinding strip can, for example, be removably attached to either of the grinding strip holders. With this embodiment, the sharpening angle can be determined by the adapter strip and can also be selected subsequently.

In this case, the adapter strip is positively held at the grinding strip holder, in particular via a bottom guide, and a snap connection exists between the adapter strip and the grinding strip holder.

The adapter strip has a first lateral edge contacting the grinding strip holder and a second lateral edge holding the grinding strip, wherein the two lateral edges together form an acute angle which widens towards the bottom.

In an embodiment of the present invention, apart from the pair of adapter strips attached to the two grinding strip holders, there can, for example, be another pair of adapter strips that form an acute angle that differs from the angle formed by the first pair of adapter strips. The device has at least one compartment for storing the second pair of adapter strips therefor. The storage compartment may be arranged in the lower base of the device.

Three embodiments of the present invention are shown in a perspective view in the drawings.

The knife sharpening device has a cuboid enclosure 1 whose height H is larger than its width B and whose width B is larger than its depth T. The vertical front wall and the vertical rear wall 2 each have a vertical insertion slot 3 corresponding to the V-shaped sharpening slot 10 formed by and between the grinding strips 4, 5.

Within the enclosure 1, two plate-like grinding strip holders 6, 7 are movably mounted with their vertical plates arranged parallel to the vertical front wall and the vertical rear wall 2. Both grinding strip holders have a narrow end face 8, 9, each extending top down at an angle and each holding one grinding strip 4, 5. The end faces 8, 9 together with the grinding strips 4, 5 form an angle $\alpha$ as a V-shaped movable sharpening slot 10.

When a knife is guided with its blade top down through the two vertical insertion slots 3 of the vertical front wall and the vertical rear wall 2, the blade touches the V-shaped sharpening slot 10 and the two grinding strips 4, 5 so that when the blade is moved further down, the two grinding strips 4, 5 are urged apart. The two grinding strip holders 6, 7 are thereby also moved apart in opposite directions (arrows 11, 12).

Both grinding strip holders 6, 7 are each hinged on two pendulum rods 13, 14, 15, 16 so that when a knife is pulled through, the two grinding strip holders 6, 7 can move smoothly apart in both directions. The pendulum rods of each grinding strip holder are arranged parallel to one another, with the lower ends of a pair of pendulum rods 13, 14 or 15, 16, respectively, being hinged on a lower section 17 or 18 of the respective grinding strip holder 6, 7 via lower joints UG.

The upper ends of the pendulum rods 13, 14, 15, 16 are attached to the enclosure 1 via upper joints OG and with these to the vertical front wall and the vertical rear wall 2 or to an enclosure top 19. Each grinding strip holder 6, 7 has at its top at least one projection 20 that is inserted in a longitudinal slot 21 in the enclosure top 19. At its lower end, each grinding strip holder 6, 7 has two bar-shaped projections 22 that are inserted into and through longitudinal slots 23 of an enclosure bottom so that the grinding strip holders 6, 7 are reliably guided parallel next to each other in their movements.

Between the two projections 22 of both grinding strip holders 6, 7, a spring element, in particular a helical tension spring 24, is attached that pulls the two grinding strip holders 6, 7 into the initial position in which the two grinding strip holders 6, 7 overlap to the maximum extent and hence the V-shaped sharpening slot 10 is in its topmost position. This initial position is shown in the drawings and exists when no knife has yet been inserted. A helical tension spring 24 attached in this way provides that both grinding strip holders 6, 7 are spring-loaded with the same force and the middle of the V-shaped sharpening slot 10 always corresponds to the middle of the vertical insertion slots 3 in the vertical front wall and the vertical rear walls 2.

As an alternative, each grinding strip holder 6, 7 has a lateral projection, in particular a projecting pin, at which one end of a tension spring is attached whereas the other end of the tension spring is attached to the enclosure 1.

The two grinding strip holders 6, 7 may also be spring-loaded by other kinds of spring elements, in particular by two separate springs.

Figure 2:
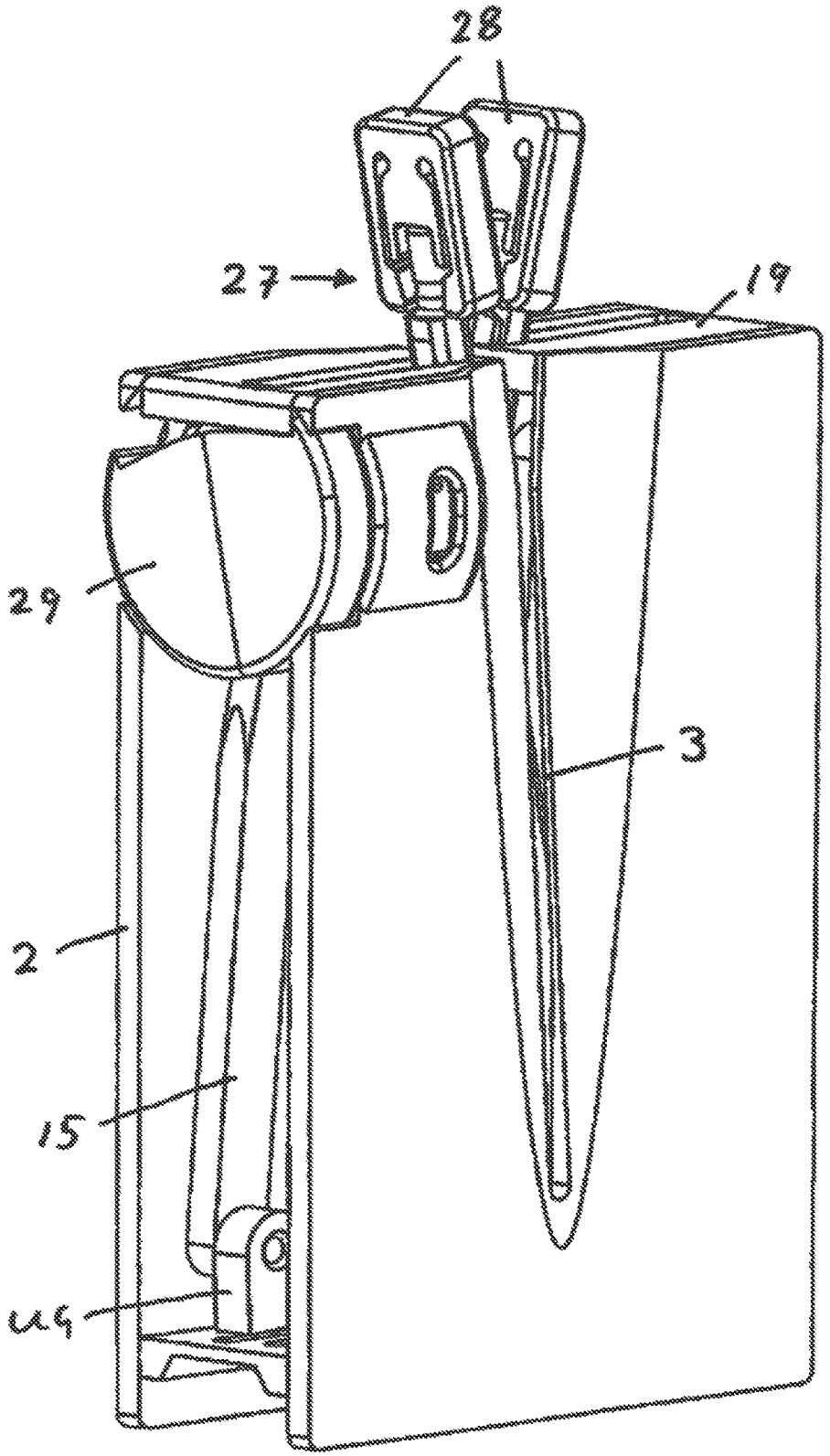
FIG. 2 shows a second embodiment of the present invention with a front wall.
Figure 3:
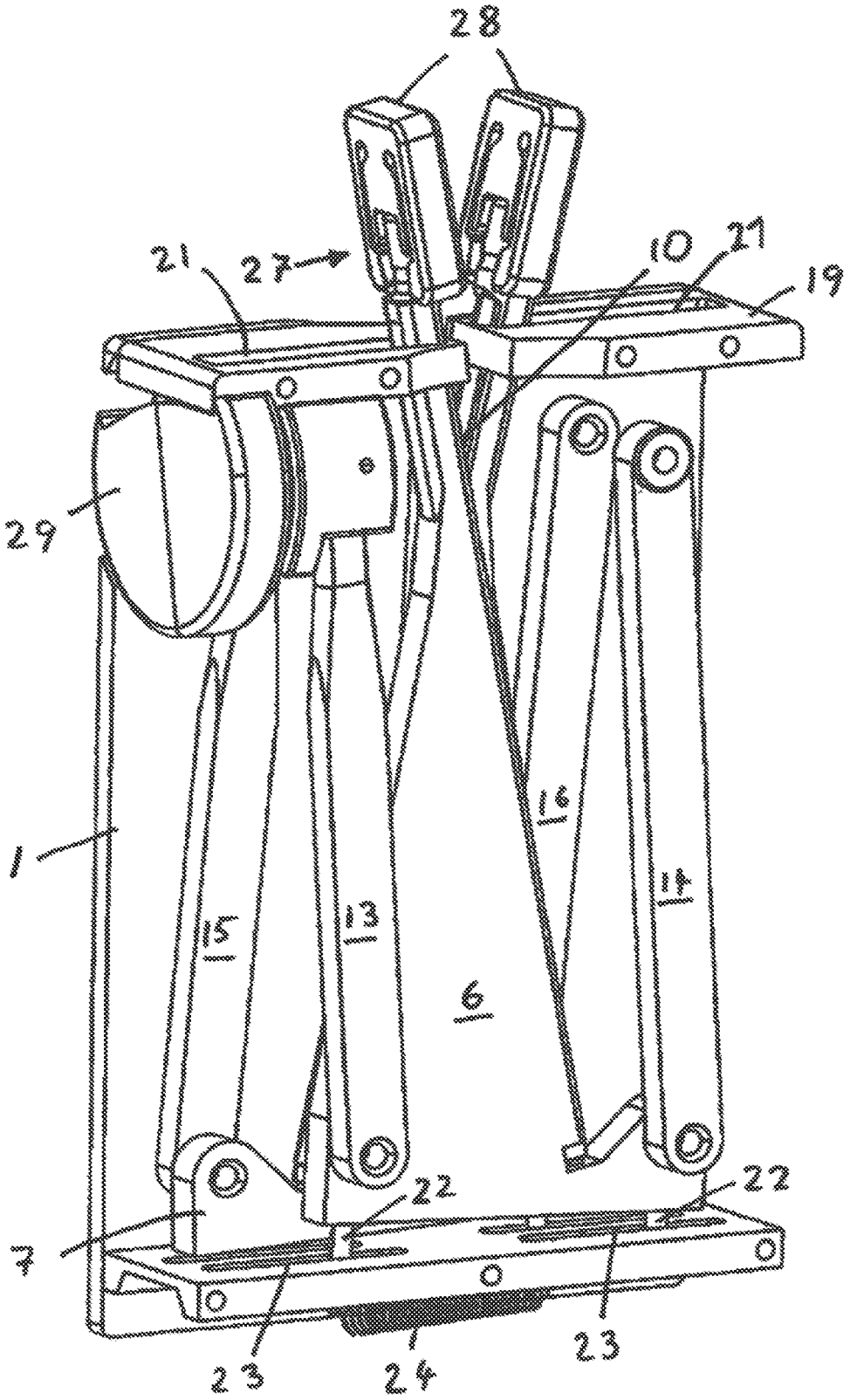
FIG. 3 shows the second embodiment of the present invention without a front wall.
Figure 4:
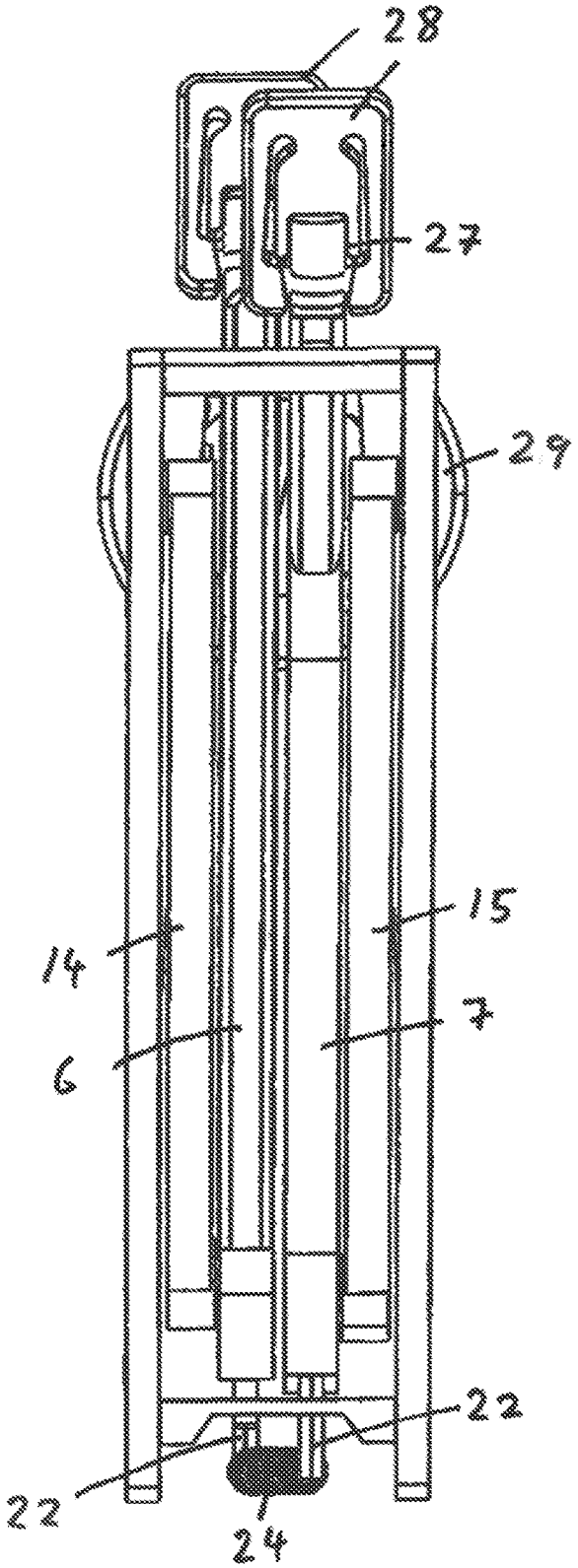
FIG. 4 shows the narrow side of the second embodiment of the present invention.

Form and fastening of the grinding strips 4, 5 can vary considerably. In the embodiment shown in FIG. 1, the grinding strips 4, 5 are formed by flat bars and fastened in various ways at the end faces 8, 9 of the grinding strip holders 6, 7. In the second embodiment shown in FIGS. 2 to 4, the end faces 8, 9 each form a longitudinal groove in which one grinding strip 4, 5 each is inserted so that one section of the grinding strip projects out through the slot 21. In this case, the longitudinal groove partly engages the grinding strip 4, 5 at least in a bottom section.

In the second embodiment, each grinding strip 4, 5 has a circular or polygonal cross-section, and the longitudinal grooves have a corresponding cross-section so that the grinding strips 4, 5 can be adjusted by rotation about their longitudinal axis as bars within the longitudinal grooves. The bar-like grinding strips 4, 5 each have one or more lateral areas, for example, with sections of different roughness, that can be adjusted by rotating the grinding strips 4, 5 about their longitudinal axis. One section may be a honing section and the other may be a grinding section.

The grinding strips 4, 5 can be pulled out of the longitudinal grooves to the top and can be inserted again from the top in order to replace them. Each of the, in particular bar-like, grinding strips 4, 5 has at its top end a handle 28 which projects from the top of enclosure 1 and can be used to rotate and adjust, pull out and/or re-insert the grinding strips 4, 5. A ratchet and pawl mechanism 27 (two-sided positive restraint) is arranged between an upper projecting section of the grinding strip holder 6, 7 and the handle 28 so that the grinding strips 4, 5 can be manually rotated at the handle 28 into the position in which the area with the desired roughness faces the V-shaped sharpening slot 10.

For both of the grinding strip holders 6, 7, one of the two upper hinges (joints OG) is vertically adjustable, whereby the angle α of the V-shaped sharpening slot 10 can be adjusted. To this effect, a cylindrical rotary slide 29 inside the enclosure 1 is provided at one end face of the enclosure 1, with one side of the rotary slide 29 being linked with a joint OG of one grinding strip holder 6 and the opposite side of the rotary slide 29 being linked with a joint OG of the other grinding strip holder 7. When the rotary slide 29 is rotated in one direction of rotation, the joint of the one grinding strip holder is raised and the joint of the other grinding strip holder is lowered whereby the two grinding strip holders 6, 7 are swivelled by the same angle in opposite directions so that the V-shaped sharpening slot 10 is symmetrically widened or narrowed.

Figure 5:
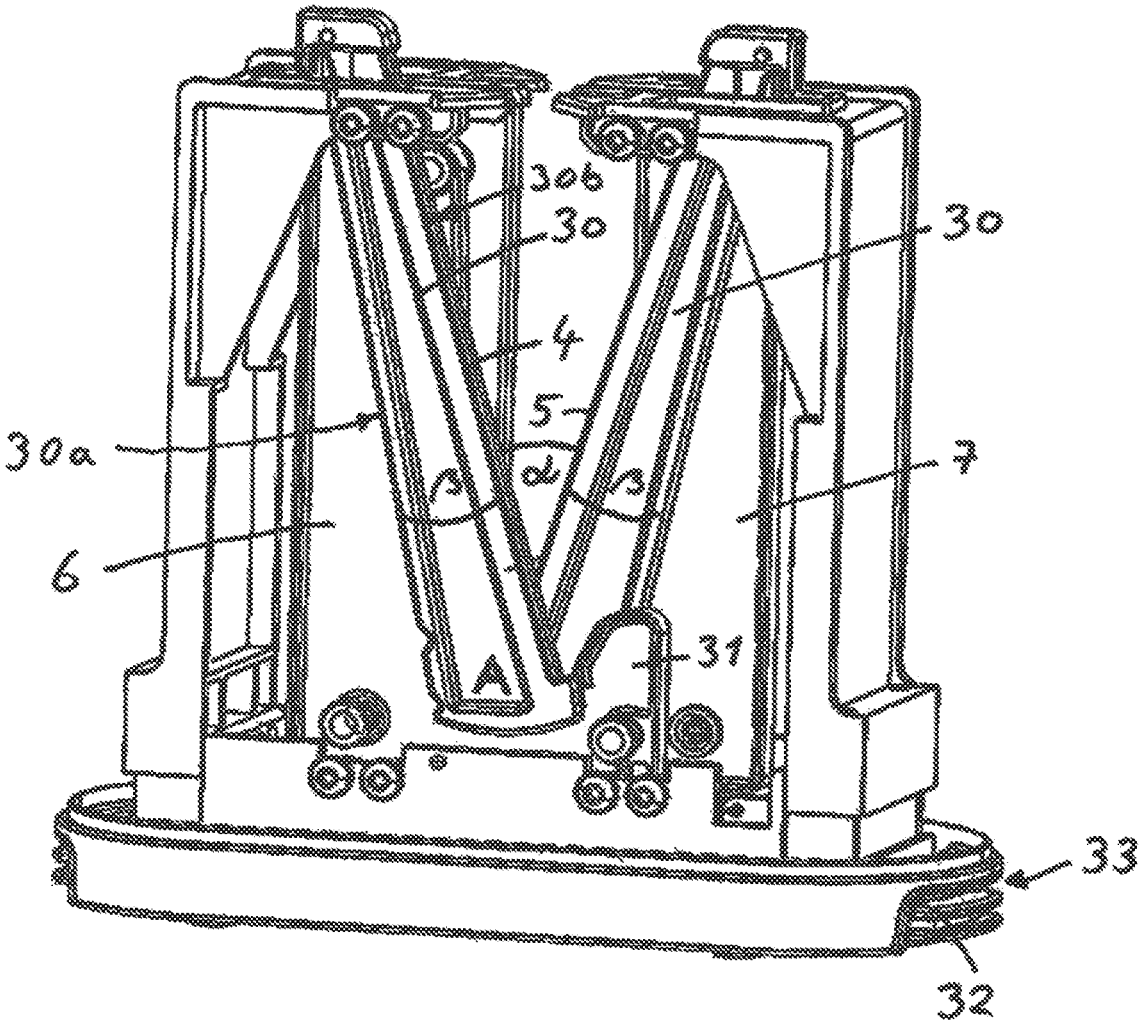
FIG. 5 shows a perspective view of a third embodiment of the present invention.

In another embodiment shown in FIG. 5, an adapter strip 30 is removably attached to each of the grinding strip holders 6, 7. Each of these adapter strips 30 forms a connecting member between the grinding strip holder 6, 7 and the grinding strip 4, 5. A positive connection with at least one guide 31 is at least established in the lower portion. A secure hold is also provided by a snap connection.

The adapter strip 30 has a first lateral edge 30*a* contacting the grinding strip holder 6, 7 and a second lateral edge 30*b* carrying the grinding strip 4, 5, wherein the two lateral edges 30*a*, 30*b* form an acute angle β therebetween that widens downward. Depending on which acute angle β is formed by the adapter strip 30, a wider or narrower acute sharpening angle α between the two grinding strips 4, 5 is formed.

To meet different requirements, the sharpening device may also be supplied with at least one other pair of adapter strips 32. This additional pair of adapter strips 32 can be accommodated in one or two storage compartments 33 in the base of the device.

The present invention is not limited to embodiments described herein; reference should be had to the appended claims.

What is claimed is:

1. A device for sharpening a knife, the device comprising:
an enclosure;
a first grinding strip and a second grinding strip;
a first grinding strip holder and a second grinding strip holder, each of which comprise a lower section, the first grinding strip holder being configured to hold the first grinding strip and the second grinding strip holder being configured to hold the second grinding strip, the first grinding strip holder and the second grinding strip holder being movably arranged next to each other in the enclosure so that the first grinding strip and the second grinding strip intersect to form a movable sharpening slot having a V-shape; and
a first pendulum rod, a second pendulum rod, a third pendulum rod, and a fourth pendulum rod,
wherein,
the first pendulum rod and the second pendulum rod are hinged to the first grinding strip holder at the lower section via a lower joint, and
the third pendulum rod and the fourth pendulum rod are hinged to the second grinding strip holder at the lower section via a lower joint.

2. The device as recited in claim 1, wherein,
the enclosure comprises an upper section, and
the first pendulum rod, the second pendulum rod, the third pendulum rod, and the fourth pendulum rod are each hinged in the upper section of the enclosure.

3. The device as recited in claim 1, wherein,
the first grinding strip holder is formed by a first plate member,
the second grinding strip holder is formed by a second plate member, and
the first plate member and the second plate member are arranged parallel next to each other.

4. The device as recited in claim 1, wherein,
the first grinding strip holder further comprises an upper section which is guided in the enclosure, and
the second grinding strip holder further comprises an upper section which is guided in the enclosure.

5. The device as recited in claim 4, wherein,
the enclosure comprises a top which comprises a first longitudinal slot and a second longitudinal slot,
the first grinding strip holder further comprises at least one projection at a top, the at least one projection of the first grinding strip holder being inserted in the first longitudinal slot in the top of the enclosure, and
the second grinding strip holder further comprises at least one projection at a top, the at least one projection of the second grinding strip holder being inserted in the second longitudinal slot in the top of the enclosure.

6. The device as recited in claim 1, wherein,
the lower section of the first grinding strip holder is guided in the enclosure, and
the lower section of the second grinding strip holder is guided in the enclosure.

7. The device as recited in claim 6, wherein,
the enclosure comprises a bottom which comprises a plurality of longitudinal slots,
the first grinding strip holder further comprises at least one projection at a bottom, the at least one projection of the first grinding strip holder being inserted in a first one of the plurality of longitudinal slots in the bottom of the enclosure, and
the second grinding strip holder further comprises at least one projection at a bottom, the at least one projection of the second grinding strip holder being inserted in a second one of the plurality of longitudinal slots in the bottom of the enclosure.

8. The device as recited in claim 7, further comprising:
at least one spring element,
wherein,
each of the first grinding strip holder and the second grinding strip holder are spring-loaded by the at least one spring element.

9. The device as recited in claim 8, wherein,
the at least one spring element is a tension spring which is attached between one of the at least one projection of the first grinding strip holder and one of the at least one projection of the second grinding strip holder;
or,
the at least one spring element is provided as a first tension spring and a second tension spring,
the first tension spring is attached between the enclosure and one of the at least one projection of the first grinding strip holder, and
the second tension spring is attached between the enclosure and one of the at least one projection of the second grinding strip holder.

10. The device as recited in claim 1, wherein each of the first grinding strip and the second grinding strip are configured to be adjusted by rotation about their respective longitudinal axis.

11. The device as recited in claim 10, wherein, the first grinding strip holder further comprises an end face which comprises a longitudinal groove, and the second grinding strip holder further comprises an end face which comprises a longitudinal groove, the first grinding strip is mounted in the longitudinal groove of the first grinding strip holder so as to be at least one of removable and rotatably adjustable, and the second grinding strip is mounted in the longitudinal groove of the second grinding strip holder so as to be at least one of removable and rotatably adjustable.

12. The device as recited in claim 11, wherein, the first grinding strip further comprises at least two longitudinally arranged sections which comprise a different roughness, and the second grinding strip further comprises at least two longitudinally arranged sections which comprise a different roughness.

13. The device as recited in claim 12, wherein, the first grinding strip is configured to be pulled upwards out of the longitudinal groove of the first grinding strip holder so as to be replaceable, and the second grinding strip is configured to be pulled upwards out of the longitudinal groove of the second grinding strip holder so as to be replaceable.

14. The device as recited in claim 1, further comprising:

a first adapter strip which is removably attached to the first grinding strip holder, the first adapter strip being configured to hold the first grinding strip, a second adapter strip which is removably attached to the second grinding strip holder, the second adapter strip being configured to hold the second grinding strip, wherein, a positive connection exists between the first adapter strip and the first grinding strip holder via a first lower guide, a positive connection exists between the second adapter strip and the second grinding strip holder via a second lower guide, a snap connection exists between the first adapter strip and the first grinding strip holder, and a snap connection exists between the second adapter strip and the second grinding strip holder.

15. The device as recited in claim 14, wherein, the first adapter strip comprises a first lateral edge which is configured to contact the first grinding strip holder and a second lateral edge which is configured to carry the first grinding strip, the first lateral edge of the first adapter strip and the second lateral edge of the first adapter strip forming an acute angle therebetween which widens downwards, and the second adapter strip comprises a first lateral edge which is configured to contact the second grinding strip holder and a second lateral edge which is configured to carry the second grinding strip, the first lateral edge of the second adapter strip and the second lateral edge of the second adapter strip forming an acute angle therebetween which widens downwards.

* * * * *